US011851807B2

(12) United States Patent
Masters

(10) Patent No.: US 11,851,807 B2
(45) Date of Patent: Dec. 26, 2023

(54) METHOD OF REMOVING HEAT FROM A CLOTHES TUMBLING SYSTEM ON THE OUTSIDE OF THE CABINET

(71) Applicant: WHIRLPOOL CORPORATION, Benton Harbor, MI (US)

(72) Inventor: Roy E. Masters, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 687 days.

(21) Appl. No.: 17/023,488

(22) Filed: Sep. 17, 2020

(65) Prior Publication Data

US 2021/0140093 A1 May 13, 2021

Related U.S. Application Data

(60) Provisional application No. 62/931,932, filed on Nov. 7, 2019.

(51) Int. Cl.
*D06F 58/24* (2006.01)
*D06F 58/04* (2006.01)

(52) U.S. Cl.
CPC ..... *D06F 58/24* (2013.01); *D06F 58/04* (2013.01)

(58) Field of Classification Search
CPC ..... D06F 58/24
See application file for complete search history.

(56) References Cited

U.S. PATENT DOCUMENTS

| | | | | |
|---|---|---|---|---|
| 8,590,172 | B2 | 11/2013 | Ahn et al. | |
| 9,249,538 | B2 | 2/2016 | Bison et al. | |
| 9,534,329 | B2 | 1/2017 | Contarini et al. | |
| 9,869,052 | B2 | 1/2018 | Liang et al. | |
| 10,006,721 | B2 | 6/2018 | Kohavi et al. | |
| 10,184,207 | B2 | 1/2019 | Kim et al. | |
| 10,196,774 | B2 | 2/2019 | Jung et al. | |
| 10,995,448 | B2 * | 5/2021 | Masters | D06F 58/04 |
| 11,427,953 | B2 * | 8/2022 | Masters | D06F 37/26 |
| 2012/0233876 | A1 | 9/2012 | Weldon et al. | |
| 2015/0345866 | A1 * | 12/2015 | Yu | D06F 58/206 34/73 |
| 2016/0168777 | A1 | 6/2016 | Bison et al. | |
| 2017/0030007 | A1 * | 2/2017 | Kim | F28F 21/062 |
| 2017/0247831 | A1 | 8/2017 | Hayes | |

(Continued)

FOREIGN PATENT DOCUMENTS

| | | |
|---|---|---|
| EP | 1925712 | 5/2008 |
| EP | 2042646 | 4/2009 |

(Continued)

*Primary Examiner* — David J Laux
(74) *Attorney, Agent, or Firm* — Price Heneveld LLP

(57) ABSTRACT

A drying appliance includes a cabinet. A blower directs process air through a closed-loop airflow path and through a processing chamber and a condensing unit. The condensing unit is attached to an external surface of the cabinet. An open airflow path directs ambient air through the condensing unit and to an area exterior to the cabinet. The ambient air remains separated from the closed-loop airflow path. The condensing unit is configured to exchange heat between the process air within the closed-loop airflow path and the ambient air moved through the open airflow path. The ambient air cools and dehumidifies the process air to form condensate on an interior surface of the condensing unit.

20 Claims, 4 Drawing Sheets

(56) References Cited

U.S. PATENT DOCUMENTS

| | | | |
|---|---|---|---|
| 2017/0268159 | A1 | 9/2017 | Brown |
| 2018/0245269 | A1 | 8/2018 | Bing et al. |
| 2018/0251933 | A1 | 9/2018 | Park et al. |
| 2019/0169785 | A1 | 6/2019 | Seo et al. |
| 2021/0095416 | A1* | 4/2021 | Masters ..... A47L 15/0097 |

FOREIGN PATENT DOCUMENTS

| | | |
|---|---|---|
| EP | 2166145 | 3/2010 |
| EP | 2322708 | 5/2011 |
| EP | 2565321 | 3/2013 |
| JP | 55136496 | 9/1980 |
| JP | 5685694 | 7/1981 |
| JP | 57124398 | 8/1982 |

* cited by examiner

METHOD OF REMOVING HEAT FROM A CLOTHES TUMBLING SYSTEM ON THE OUTSIDE OF THE CABINET

CROSS-REFERENCE TO RELATED APPLICATION

This application claims priority to and the benefit under 35 U.S.C. § 119(e) of U.S. Provisional Patent Application No. 62/931,932, filed on Nov. 7, 2019, entitled METHOD OF REMOVING HEAT FROM A CLOTHES TUMBLING SYSTEM ON THE OUTSIDE OF THE CABINET, the entire disclosure of which is hereby incorporated herein by reference.

FIELD OF THE DISCLOSURE

The device relates to the technical field of laundry appliances, and more specifically, condensing drying machines for condensing moisture from an internal airflow system. Conventional condensing drying machines include an air-to-air heat exchanger disposed internally to a cabinet for condensing moisture from the internal airflow system.

SUMMARY OF THE DISCLOSURE

According to one aspect of the present disclosure, a drying appliance includes a cabinet. A blower directs process air through a closed-loop airflow path and through a processing chamber and a condensing unit. The condensing unit is attached to an external surface of the cabinet. An open airflow path directs ambient air through the condensing unit and to an area exterior to the cabinet. The ambient air remains separated from the closed-loop airflow path. The condensing unit is configured to exchange heat between the process air within the closed-loop airflow path and the ambient air moved through the open airflow path. The ambient air cools and dehumidifies the process air to form condensate on an interior surface of the condensing unit.

According to another aspect of the disclosure, a condensing dryer incudes a cabinet defining a cabinet interior. An interior fan recirculates internal process air through a closed-loop airflow path. An open airflow path directs ambient air therethrough. A condensing heat exchanger is attached to an exterior surface of the cabinet and configured to exchange heat between the process air within the closed-loop airflow path and the ambient air moved through the open airflow path. The ambient air cools and dehumidifies that process air to form condensate on an interior surface of the condensing heat exchanger.

According to yet another aspect of the present disclosure, a drying appliance includes a cabinet. A blower directs process air through a closed-loop airflow path and through a processing chamber and a condensing unit. The condensing unit is attached to an external surface of the cabinet. An open airflow path that directs ambient air through the condensing unit and to an area exterior to the cabinet. The ambient air remains separated from the closed-loop airflow path.

The components in the figures are not necessarily to scale, emphasis instead being placed upon illustrating the principles described herein.

DETAILED DESCRIPTION

Figure 1:
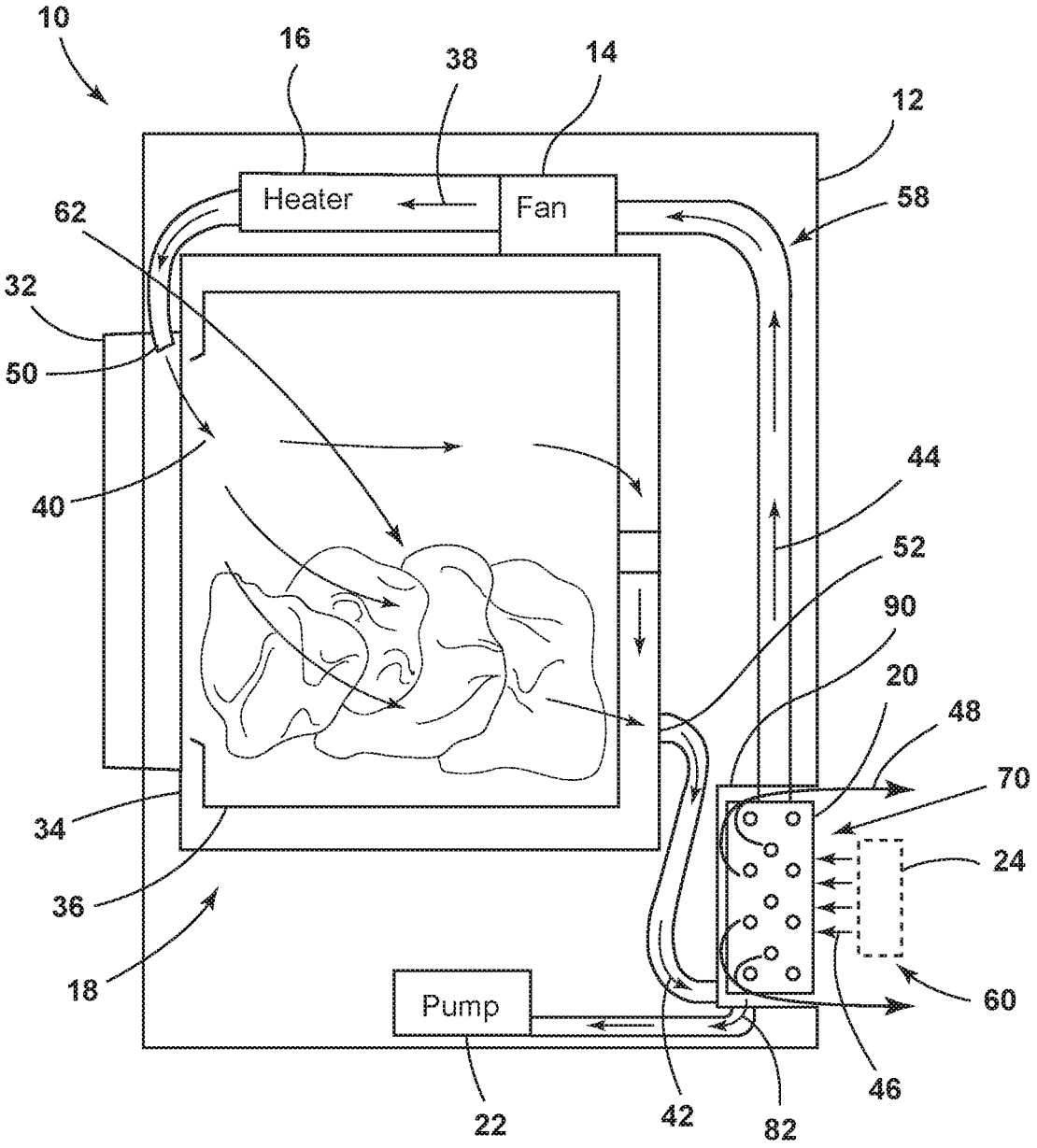
FIG. 1 is a schematic cross-sectional view of a laundry appliance incorporating an aspect of a condensing unit.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

With respect to FIGS. 1-4, a drying appliance, typically a condensing dryer 10, is shown including a cabinet 12 and having a closed-loop airflow system 58 comprising an interior fan 14, a heater 16, a tumbler 18, and a condensing unit 20. Process air 38 flowing through the closed-loop airflow system 58 is propelled by interior fan 14, typically in the form of a blower. The process air 38 is then heated by the heater 16 and travels through a tub inlet 50 as heated air 40 into the tumbler 18. The tumbler 18 is a processing chamber that may contain a load of damp articles 62 to be dried or otherwise processed. In various embodiments, the tumbler 18 includes a tub 34 and a drum 36 disposed within the tub 34. The drum 36 is positioned within the tub 34 and is configured to rotate relative to the tub 34. As the heated air 40 moves through the tumbler 18, the heated air 40 increases in humidity as it draws moisture from the damp articles 62 and exits the tumbler 18 through a tub outlet 52 as heated-humid air 42. The heated-humid air 42 then flows through the condensing unit 20. In various aspects, the condensing unit 20 comprises an air-to-air heat exchanger 70 disposed on an external surface of the cabinet 12.

Referring again to FIGS. 1-4, the heated-humid air 42 flows over one or more interior surfaces 74 of the condensing unit 20, and cool ambient air 46 flows over one or more exterior surfaces 78 of the condensing unit 20. The heated-humid air 42 is cooled and dehumidified as it passes through the condensing unit 20. In this manner, the moisture from the heated-humid air 42 condenses on the one or more interior surfaces 74 and the separated or captured condensate 82 flows downward to condensate pump 22 where the condensate 82 is pumped outside the cabinet 12. In some embodiments, the condensate pump 22 may pump the condensate 82 to a main pump. The main pump, in turn, pumps the condensate 82 and other laundry related fluids to another portion of the cabinet 12 or away from the cabinet 12. As the heated-humid air 42 travels across the one or more interior surfaces 74 of the condensing unit 20, the heated-humid air 42 is cooled and dehumidified and leaves the condensing unit 20 as cooled-dehumidified air 44. The cooled-dehumidified air 44 is then returned to the fan 14.

The condensing dryer 10 further includes an open-loop airflow system 60 having an open airflow path. In the open-loop airflow system 60, the cool ambient air 46 may flow over the condensing unit 20 by natural convection. In certain aspects of the device, an auxiliary fan 24 may be fluidly coupled with the condensing unit 20 to move ambient air 46 over the condensing unit 20 resulting in forced convection. As the cool ambient air 46 moves over the one or more exterior surfaces 78 of the condensing unit 20, the cool ambient air 46 exchanges heat with the heated-humid air 42 of the closed-loop airflow system 58 via the interior and exterior surfaces 74, 78 of the condensing unit 20. As a result, the cool ambient air 46 becomes heated ambient air 48. The heated ambient air 48 is then discharged to the room exterior to the cabinet 12. The condensing dryer 10 may further include a shroud 26 fluidly coupled with the condensing unit 20.

In some embodiments, the shroud 26 may be configured to direct the heated ambient air 48 from the condensing unit 20 through an ambient air outlet 56 of the shroud 26. In some embodiments, the ambient air outlet 56 may be coupled to an exhaust vent 28 located on the outside of an exterior wall 30 of a room and/or structure for allowing the heated ambient air 48 to pass from the open-loop airflow system 60 to the exterior environment. In other aspects, the shroud 26 may discharge the heated ambient air 48 to the room through the ambient air outlet 56. The shroud 26 may additionally form one or more ambient air inlets 54 configured to allow the ambient air 46 to flow past the shroud 26 and over the condensing unit 20 before flowing out of the ambient air outlet 56.

Figure 2:
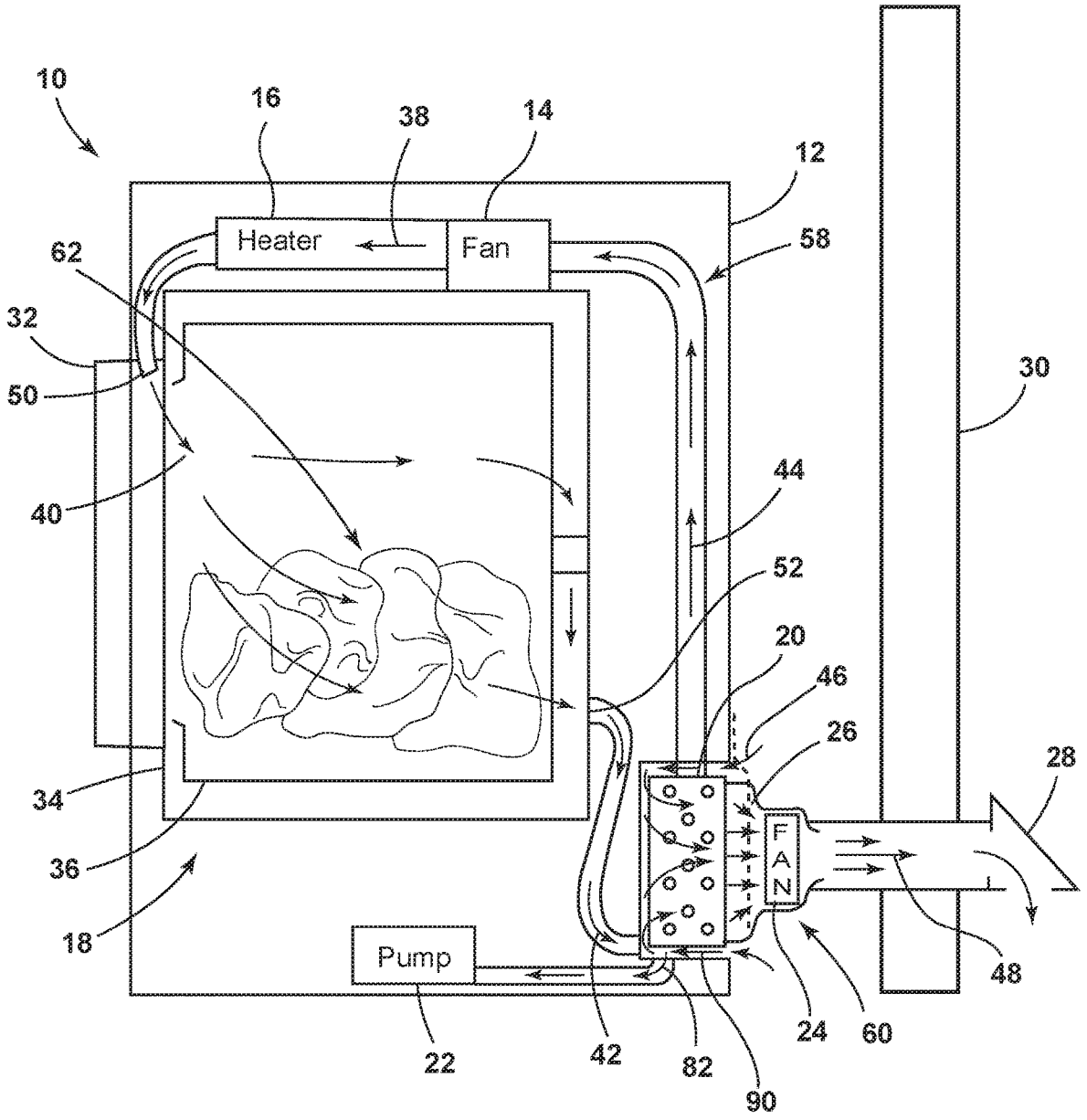
FIG. 2 is a schematic cross-sectional view of a laundry appliance incorporating an aspect of a condensing unit.
Figure 3:
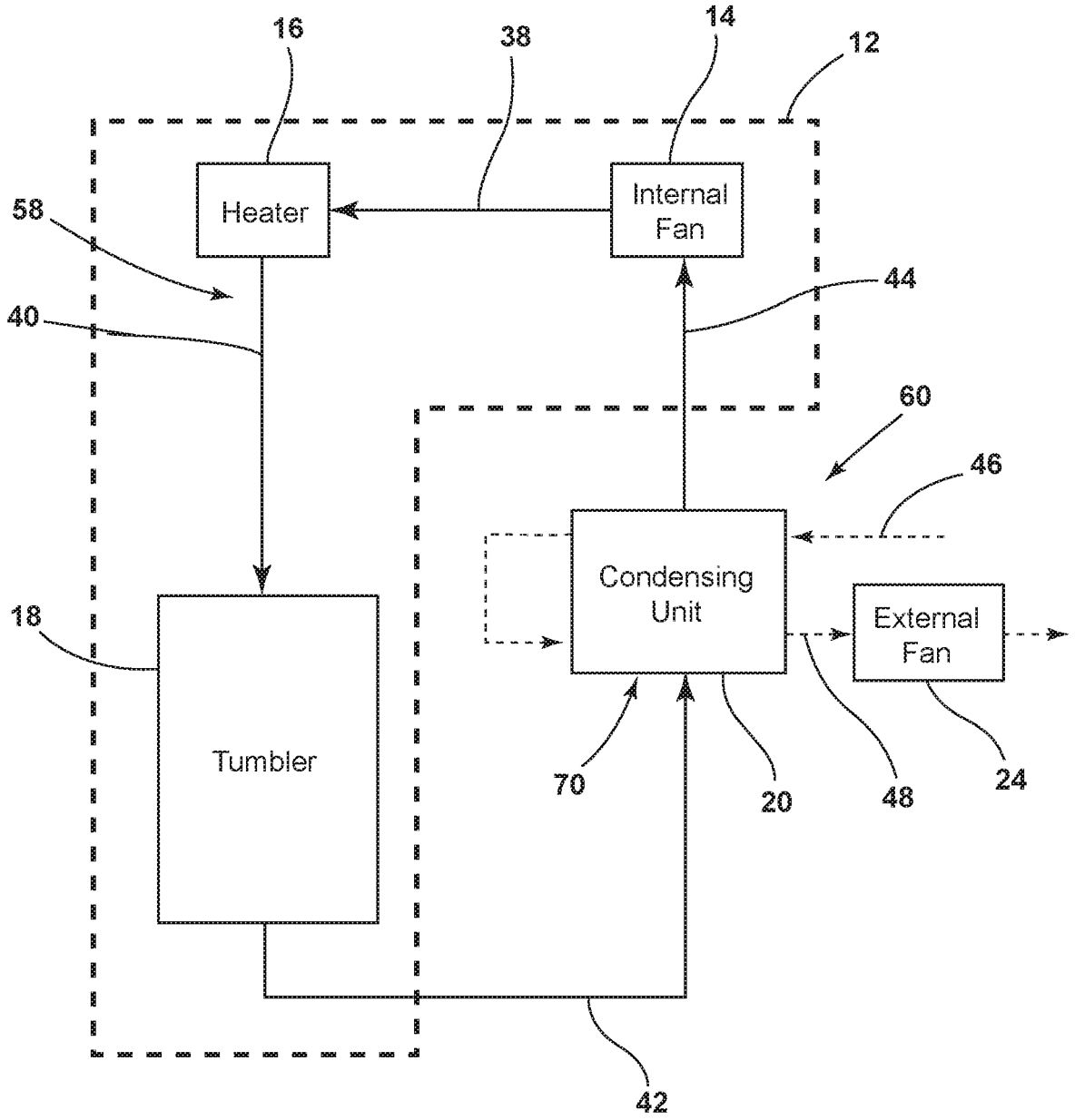
FIG. 3 is a schematic diagram illustrating the operation of the open-loop airflow system and the closed-loop airflow system.

Referring now to FIGS. 1-3, the cabinet 12 defines an interior of the condensing dryer 10 and provides space in which the tumbler 18 and any other components may be arranged. According to various aspects, the cabinet 12 may be formed in a generally rectangular shape. The cabinet 12 generally includes a front cover, a top plate, side covers, a rear cover, and a base. An opening is formed, typically, in the front cover of the cabinet 12. The opening of the cabinet 12 is aligned with an opening of the tumbler 18 allowing a user to load damp articles 62 into the tumbler 18 from the front of the cabinet 12. A door 32 is coupled to the opening of the front cover of the cabinet 12 by a hinge such that the door 32 may be selectively opened and closed by the user allowing access to an interior of the tumbler 18. According to some embodiments, the door 32 includes an inwardly protruding portion such that an inside surface of the door 32 is substantially flush with the opening of the tumbler 18.

The interior fan 14 is disposed within the interior of the cabinet 12. Process air 38 in the closed-loop airflow system 58 is circulated or recirculated by the interior fan 14 through a closed-loop airflow path. The interior fan 14 may be an axial fan, but any practical fan type is contemplated. As shown, the interior fan 14 is disposed in an upper portion of the cabinet 12; however, in various embodiments, the interior fan 14 may be disposed in any suitable position for circulating air through the closed-loop airflow system 58.

The condensing dryer 10 includes the heater 16. In some aspects, the heater 16 may be disposed downstream from the interior fan 14. The heater 16 receives process air 38 from the interior fan 14 and generates heated air 40. The heater 16 may include an electric resistance heater, a gas heater, a condensing heater or any practical heater for heating the process air 38 within the closed-loop airflow system 58. As shown, the heater 16 is positioned in an upper portion of the interior cabinet 12 and is downstream from the interior fan 14; however, it is contemplated that the heater 16 may be positioned in any suitable location and/or position within the closed-loop airflow system 58 for providing heated air 40 to the tumbler 18.

The tumbler 18 is disposed within the interior of the cabinet 12 and is fluidly coupled to the fan 14 and the heater 16. The tumbler 18 is formed in a cylindrical shape and the front surface thereof typically defines an opening. The opening of the tumbler 18 is at least partially aligned with the opening formed in the front surface of the cabinet 12. In addition, the tub inlet 50 may be formed in an upper portion of the tumbler 18 proximate the opening to allow heated air 40 from the closed-loop airflow system 58 to enter the tumbler 18. The tumbler 18 further includes a tub outlet 52 disposed toward the back of the tumbler 18 to allow the heated-humid air 42 from the closed-loop airflow system 58 to exit the tumbler 18. While the tub inlet 50 is depicted at an upper portion of the tumbler 18 toward the front of the condensing dryer 10 and the tub outlet 52 is depicted at a bottom portion toward the rear of the condensing dryer 10, it is contemplated that the locations of the tub inlet 50 and the tub outlet 52 may vary according to the designs of various embodiments.

During operation, the tumbler 18 typically contains a load of articles 62 to be dried, refreshed, sanitized or otherwise processed. The drum 36 is rotated within the tub 34 and includes one or more lifters disposed on an inside surface of the drum 36 for lifting the damp articles 62 within the tumbler 18 as the drum 36 rotates during operation. The heated air 40 enters the tumbler 18 through the tub inlet 50 and absorbs moisture from the damp articles 62 to form heated-humid air 42. The heated-humid air 42 then exits the tumbler 18 through the tub outlet 52.

In various aspects, the condensing dryer 10 may be a washer/dryer combination machine. Further, a filter is typically included at the tub outlet 52 of the tumbler 18 for trapping lint and/or other particulates to prevent these particles from accumulating within the closed-loop airflow system 58 resulting in decreased airflow of the closed-loop airflow system 58 and diminished drying performance of the condensing unit 20.

The condensing unit 20 generally comprises an air-to-air heat exchanger 70. According to the various embodiments, the condensing unit 20 is disposed exterior to the cabinet 12. Generally, the condensing unit 20 is a cross-flow heat exchanger comprising a plurality of airflow tubes 86 through which heated-humid air 42 from the tumbler 18 flows. The exterior of the plurality of airflow tubes 86 are surrounded by cool ambient air 46 that flows around the airflow tubes 86. In this manner, the airflow tubes 86 provide for an exchange of heat from the heated-humid air 42 to the cool ambient air 46. Accordingly, heat is exchanged from the heated-humid air 42 of the closed-loop airflow system 58 to the cool ambient air 46 of the open-loop airflow system 60.

The heated-humid air 42 from the tumbler 18 is hotter than the cool ambient air 46. As the heated-humid air 42 passes through the plurality of airflow tubes 86, the heated-humid air 42 is cooled and dehumidified. Through this dehumidification process within and around the airflow tubes 86, the moisture absorbed from the damp articles 62 forms condensate 82 on the interior surfaces 74 of the airflow tubes 86 and the condensing unit 20. The heated-humid air 42 in the closed-loop airflow system 58 is thereby cooled and dehumidified and moisture is removed from the load of damp articles 62. The cooled-dehumidified air 44 exits the condensing unit 20 through operation of the interior fan 14. The condensate 82 from the condensing unit 20 is directed, typically according to the force of gravity, to the condensate pump 22. The condensate pump 22 directs the condensate 82 to another portion of the dryer 10 or, in certain aspects, directs the condensate 82 to an area outside of the cabinet 12, typically to a drain. In embodiments where the condensing dryer 10 is a washer/dryer combination machine, the condensate 82 may be pumped from condensate pump 22 to a main pump and subsequently removed from the cabinet 12.

According to the various aspects of the device, the condensing unit 20 is disposed on an exterior of the cabinet 12 such that the heat exchanged from the closed-loop airflow system 58 is rejected in an area outside of the cabinet 12. The temperature of the interior of the cabinet 12 is often hotter than the temperature of the exterior of the cabinet 12 due to the heater 16 and other mechanical and electrical components of the dryer 10. Therefore, by positioning the condensing unit 20 on an exterior to the cabinet 12, the interior and exterior surfaces 74, 78 of the condensing unit 20 are maintained within a colder environment and at a colder temperature. In addition, with the condensing unit 20 positioned exterior to the cabinet 12, a constant and consistent supply of cool ambient air 46 is available to perform the heat exchange function of the condensing unit 20. As the interior and exterior surfaces 74, 78 of the condensing unit 20 are maintained at a colder temperature outside of the cabinet 12, the condensing unit 20 is able to dehumidify significant amounts of condensate 82 from the heated-humid air 42 within the closed-loop airflow system 58. This configuration of the condensing unit 20 allows for the dehumidification of the heated-humid air 42, as well as drying of damp articles 62 in a shorter amount of time, thereby increasing the efficiency of the condensing dryer 10.

According to various aspects, the cool ambient air 46 flows over one or more exterior surfaces 78 of the condensing unit 20 and exchanges heat with the closed-loop airflow system 58 by natural convection. In such embodiments, as the cool ambient air 46 exchanges heat with the heated-humid air 42 of the closed-loop airflow system 58, the cool ambient air 46 increases in temperature and decreases in density to become heated ambient air 48. Due to the decreased density of the heated ambient air 48, the heated ambient air 48 rises. As the heated ambient air 48 rises, a low-pressure zone is created in the space the heated ambient air 48 vacates. Cool ambient air 46 is then drawn into the low-pressure zone to occupy the space vacated by the rising of the heated ambient air 48. Typically, the cool ambient air 46 is drawn in from a lower portion of the condensing unit 20. As the cool ambient air 46 is drawn in, it is heated through the thermal exchange with the heated-humid air 42 of the closed-loop airflow system 58 to become heated ambient air 48. The heated ambient air 48 then rises, drawing in additional cool ambient air 46 over the one or more exterior surfaces 78 of the condensing unit 20. This process of natural convection is continuously repeated during operation of the condensing dryer 10. This process of natural convection is made more efficient and expedient due to the positioning of the condensing unit 20 on an exterior of the cabinet 12. Again, the continuous and consistent supply of cool ambient air 46 outside of the cabinet 12 allows for the use of natural convection.

According to some embodiments, the condensing dryer 10 may include an exterior fan 24 fluidly coupled with the one or more exterior surfaces 78 of the condensing unit 20. The exterior fan 24 circulates cool ambient air 46 over the one or more exterior surfaces 78 of the condensing unit 20. As the cool ambient air 46 travels over the one or more exterior surfaces 78 of the condensing unit 20, the cool ambient air 46 exchanges heat with the heated-humid air 42 of the closed-loop airflow system 58 through forced convection. In certain aspects of the device, the use of the exterior fan 24 can supplement the natural convection. Accordingly, where the condensing dryer 10 operates in a quick dry cycle, the exterior fan 24 can provide for an increased flow of ambient air through the condensing unit 20 and around the airflow tubes 86. Also, where the condensing dryer 10 is operated in a low heat or fluff cycle, the heater 16 of the condensing dryer 10 may be turned off or operated at a lower temperature. In these situations, minimal amounts of heat may be transferred within the condensing unit 20. Accordingly, the exterior fan 24 may be used to increase the flow of ambient air through the condensing unit 20 and over the airflow tubes 86.

Figure 4:
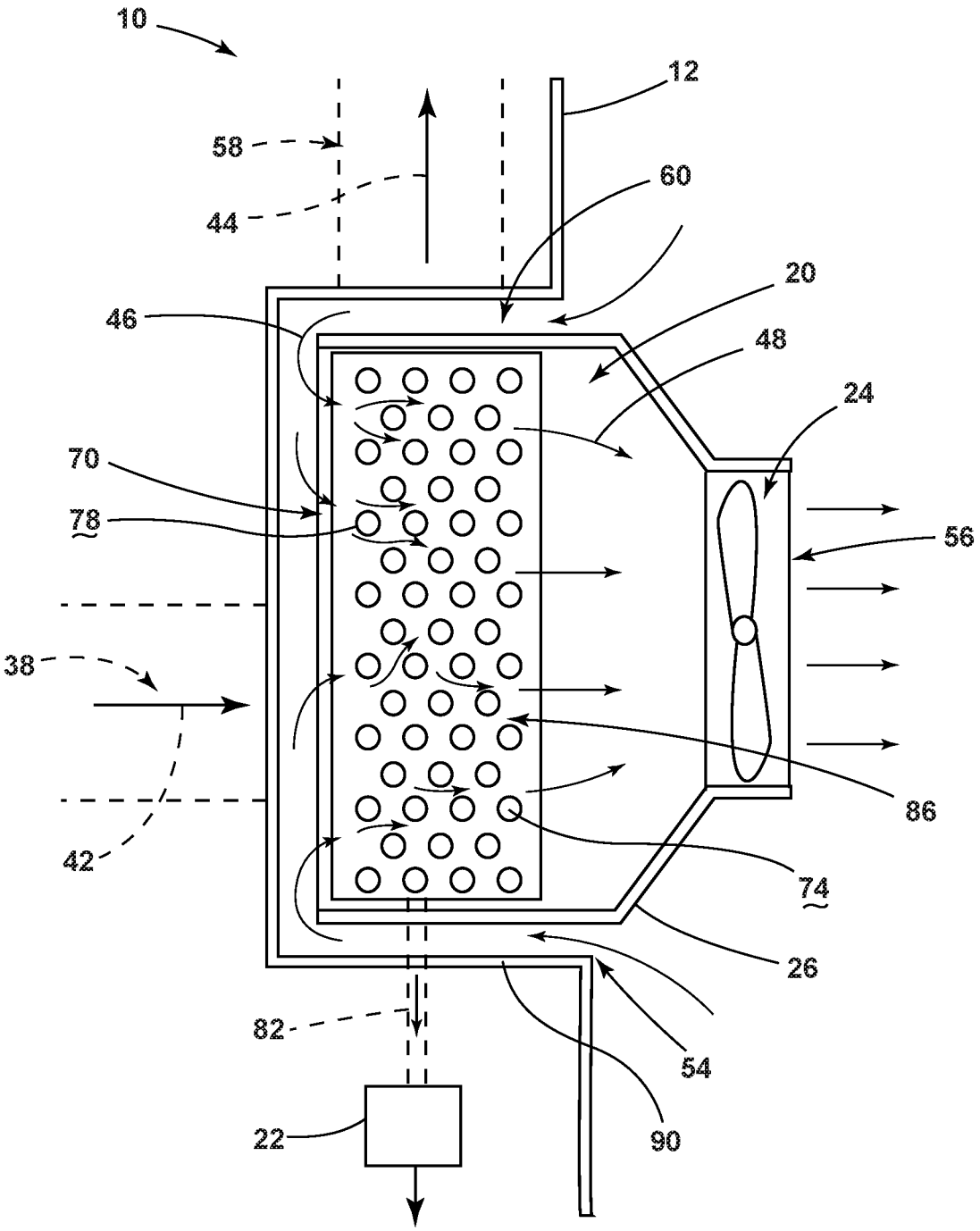
FIG. 4 is a schematic cross-sectional view of an aspect of a condensing unit showing operation of the closed-loop and open airflow paths.

Referring now to FIGS. 2 and 4, the condensing dryer 10 may further include a shroud 26 positioned proximate the condensing unit 20. The shroud 26 may include one or more ambient air inlets 54 for directing the cool ambient air 46 over the one or more exterior surfaces 78 of the condensing unit 20, such as over the airflow tubes 86. The shroud 26 further includes an ambient air outlet 56 for directing heated ambient air 48 away from the condensing unit 20. The shroud 26 may further be configured to house the exterior fan 24.

According to some aspects, the shroud 26 includes one or more air guides disposed around at least a portion of the condensing unit 20 such that cool ambient air 46 is directed through the one or more ambient air inlets 54, around the condensing unit 20, over the one or more exterior surfaces 78 of the condensing unit 20, and through the ambient air outlet 56 of the shroud 26. According to some embodiments, the shroud 26 may couple to the cabinet 12 to encase the condensing unit 20. In such embodiments, the condensing unit 20 is positioned outside of the cabinet 12, but within the shroud 26. In certain aspects, the cabinet 12 may include a recess 90 that receives the condensing unit 20, but still maintains the condensing unit 20 outside and separated from the warmer interior of the cabinet 12. In this manner, the cabinet 12 can form an outer recess 90 that houses the condensing unit 20 on an exterior of the cabinet 12, but maintains the condensing unit 20 within the outer footprint or perimeter of the condensing dryer 10. In some embodiments, the shroud 26 may be integrally formed with the rear cover of the cabinet 12 and a heat shield positioned around the condensing unit 20 to separate the condensing unit 20 from the interior of the cabinet 12.

As exemplified in FIGS. 2 and 4, the recess 90 and the shroud 26 can cooperate to form the ambient air inlet and outlet 54, 56 that directs the ambient air from outside the cabinet 12, into the condensing unit 20 and away from the cabinet 12. The ambient air inlet and outlet 54, 56 can include channels, vents, apertures or other openings that extend between the shroud 26 and the cabinet 12 to define the ambient air inlet and outlet 54, 56.

The condensing dryer 10 may further include a vent 28 fluidly coupled to the ambient air outlet 56 of the shroud 26. The vent 28 directs the heated ambient air 48 to a desired location. In some embodiments, the vent 28 may extend through a wall 30 of a room or building to direct the heated ambient air 48 to an exterior of the room and/or the building, while maintaining the condensate 82 within the condensing dryer 10 to be processed separately.

Referring now to FIG. 3, the condensing dryer 10 includes the closed-loop airflow system 58 and the open-loop airflow system 60. The closed-loop airflow system 58 includes the interior fan 14, the heater 16, the tumbler 18, and the condensing unit 20. The interior fan 14, the heater 16, and the tumbler 18 are disposed in the interior of the cabinet 12 while the condensing unit 20 is disposed exterior to the cabinet 12. Process air 38 is circulated through the closed-loop airflow system 58 by the interior fan 14. Prior to entering the tumbler 18, the process air 38 is heated by the heater 16 to form heated air 40 having decreased relative humidity as compared with the process air 38. As the relative humidity is decreased, the heated air 40 is able to hold more moisture. The heated air 40 is then introduced into the tumbler 18. The tumbler 18 may contain a load of damp articles 62. As the heated air 40 travels through the tumbler 18, moisture from the damp articles 62 is absorbed into the heated air 40 to create heated-humid air 42. Through this process, the heated-humid air 42 develops an increased relative humidity as compared to the heated air 40. The heated-humid air 42 leaves the tumbler 18 and is directed to the condensing unit 20. As the heated-humid air 42 passes through the condensing unit 20, the heated-humid air 42 is cooled until the heated-humid air 42 reaches or falls below a dew point. As the heated-humid air 42 reaches the dew point, the partially-cooled humid air is now unable to hold all of the accumulated moisture. As a result, the accumulated moisture separates from the cooled air and the moisture condenses on the one or more interior surfaces 74 of the condensing unit 20. In this manner, the air is dehumidified to form cooled-dehumidified air 44. The condensate 82 is then directed exterior to the cabinet 12 of the condensing dryer 10. The cooled-dehumidified air 44 is then returned to the interior fan 14.

The open-loop airflow system 60 includes cool ambient air 46. According to some aspects, the cool ambient air 46 flows across the one or more exterior surfaces 78 of the condensing unit 20 by natural convection. According to other aspects, the open-loop airflow system 60 includes the shroud 26, the condensing unit 20, the exterior fan 24, and the vent 28. The cool ambient air 46 may be directed through one or more ambient air inlets 54 of the shroud 26 and directed over the one or more exterior surfaces 78 of the condensing unit 20. As the cool ambient air 46 passes over the one or more exterior surfaces 78 of the condensing unit 20, the cool ambient air 46 is heated as it exchanges heat with the heated-humid air 42 of closed-loop airflow system 58 to form heated ambient air 48. The heated ambient air 48 is then directed through an ambient air outlet 56 of the shroud 26. Air may be circulated through the open-loop airflow system 60 by the exterior fan 24, through natural convection, or through cooperative operation of natural and forced convection. According to some aspects, the exterior fan 24 is disposed at the ambient air outlet 56 of the shroud 26. The heated ambient air 48 travels from the ambient air outlet 56 of the shroud 26 through the vent 28 to be directed to a desired location (e.g., to the exterior of a room or building). Typically, the closed-loop airflow system 58 and the open-loop airflow system 60 intersect at the condensing unit 20 where the closed-loop airflow system 58 and the open-loop airflow system 60 exchange heat through the one or more interior surfaces 74 and/or the one or more exterior surfaces 78 of the condensing unit 20.

According to another aspect of the present disclosure, a drying appliance includes a cabinet. A blower directs process air through a closed-loop airflow path and through a processing chamber and a condensing unit. The condensing unit is attached to an external surface of the cabinet. An open airflow path directs ambient air through the condensing unit and to an area exterior to the cabinet. The ambient air remains separated from the closed-loop airflow path. The condensing unit is configured to exchange heat between the process air within the closed-loop airflow path and the ambient air moved through the open airflow path. The ambient air cools and dehumidifies the process air to form condensate on an interior surface of the condensing unit.

According to another aspect, the open airflow path operates through natural convection.

According to yet another aspect, the open airflow path includes an external fan.

According to another aspect of the present disclosure, the condensing unit is attached to the cabinet at a recess defined within the external surface of the cabinet.

According to another aspect, the condensing unit includes a shroud that directs ambient air through the condensing unit.

According to yet another aspect, the open airflow path includes an ambient air inlet that is defined between the shroud and the external surface of the cabinet.

According to another aspect of the present disclosure, the open airflow path includes an ambient air outlet that directs ambient air from the condensing unit to the area exterior to the cabinet.

According to another aspect, the ambient air outlet is configured to be located through a wall of a structure surrounding the cabinet.

According to yet another aspect, the condensing unit includes airflow tubes having an interior surface that defines a portion of the closed-loop airflow path. The airflow tubes include an exterior surface that defines a portion of the open airflow path.

According to another aspect of the present disclosure, the airflow tubes direct captured condensate to a condensate pump.

According to another aspect, the airflow tubes define a heat exchanger of the condensing unit. Heat is transferred from the process air of the closed-loop airflow path to the ambient air of the open airflow path. The heat exchanger is positioned outside of the cabinet.

According to yet another aspect, the external fan selectively operates cooperatively with a process of natural convection within the condensing unit.

According to another aspect of the present disclosure, the closed-loop airflow path includes a heater that heats the process air.

According to another aspect, a condensing dryer incudes a cabinet defining a cabinet interior. An interior fan recirculates internal process air through a closed-loop airflow path. An open airflow path directs ambient air therethrough. A condensing heat exchanger is attached to an exterior surface of the cabinet and configured to exchange heat between the process air within the closed-loop airflow path and the ambient air moved through the open airflow path. The ambient air cools and dehumidifies that process air to form condensate on an interior surface of the condensing heat exchanger.

According to yet another aspect, the open airflow path includes an external fan.

According to another aspect of the present disclosure, the condensing heat exchanger is attached to the cabinet at a recess defined within an exterior surface of the cabinet.

According to another aspect, the condensing heat exchanger includes a shroud that directs ambient air through an interior of the condensing heat exchanger. The open airflow path includes an ambient air inlet that is defined between the shroud and an exterior surface of the cabinet.

According to yet another aspect, the condensing heat exchanger includes airflow tubes having an interior surface that defines a portion of the closed-loop airflow path. The airflow tubes include an exterior surface that defines a portion of the open airflow path.

According to another aspect of the present disclosure, a drying appliance includes a cabinet. A blower directs process air through a closed-loop airflow path and through a processing chamber and a condensing unit. The condensing unit is attached to an external surface of the cabinet. An open airflow path that directs ambient air through the condensing unit and to an area exterior to the cabinet. The ambient air remains separated from the closed-loop airflow path.

According to another aspect, the condensing unit includes a shroud that directs ambient air through an interior of the condensing unit. The open airflow path includes an ambient air inlet that is defined between the shroud and an exterior surface of the cabinet.

The embodiments described above are only intended to describe the preferred embodiments of the present device, and are not intended to limit the scope of the present device, and various embodiments of the present device may be made by those skilled in the art without departing from the spirit of the device. Modifications and improvements are intended to fall within the scope of the device as defined by the appended claims.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A drying appliance comprising:

a cabinet;

a blower that directs process air through a closed-loop airflow path and through a processing chamber and a condensing unit, wherein the condensing unit is attached to an external surface of the cabinet, wherein the condensing unit includes a shroud that directs ambient air through the condensing unit; and an open airflow path that directs the ambient air through the condensing unit and to an area exterior to the cabinet, wherein the open airflow path includes an ambient air inlet that is defined between the shroud and the external surface of the cabinet, wherein the ambient air remains separated from the closed-loop airflow path, wherein the condensing unit is configured to exchange heat between the process air within the closed-loop airflow path and the ambient air moved through the open airflow path, and wherein the ambient air cools and dehumidifies the process air to form condensate on an interior surface of the condensing unit.

2. The drying appliance of claim 1, wherein the open airflow path operates through natural convection.

3. The drying appliance of claim 1, wherein the open airflow path includes an external fan.

4. The drying appliance of claim 3, wherein the external fan selectively operates cooperatively with a process of natural convection within the condensing unit.

5. The drying appliance of claim 3, wherein the external fan directs ambient air into the condensing unit.

6. The drying appliance of claim 3, wherein the external fan is disposed within the shroud.

7. The drying appliance of claim 1, wherein the condensing unit is attached to the cabinet at a recess defined within the external surface of the cabinet.

8. The drying appliance of claim 1, wherein the open airflow path includes an ambient air outlet that directs the ambient air from the condensing unit to the area exterior to the cabinet.

9. The drying appliance of claim 8, wherein the ambient air outlet is configured to be located through a wall of a structure surrounding the cabinet.

10. The drying appliance of claim 1, wherein the condensing unit includes airflow tubes having an interior surface that defines a portion of the closed-loop airflow path, wherein the airflow tubes include an exterior surface that defines a portion of the open airflow path.

11. The drying appliance of claim 10, wherein the airflow tubes direct captured condensate to a condensate pump.

12. The drying appliance of claim 10, wherein the airflow tubes define a heat exchanger of the condensing unit, wherein the heat is transferred from the process air of the closed-loop airflow path to the ambient air of the open airflow path, wherein the heat exchanger is positioned outside of the cabinet.

13. The drying appliance of claim 1, wherein the closed-loop airflow path includes a heater that heats the process air.

14. A condensing dryer comprising:

a cabinet defining a cabinet interior;

an interior fan that recirculates internal process air through a closed-loop airflow path;

an open airflow path that directs ambient air therethrough; and a condensing heat exchanger attached to an exterior surface of the cabinet and configured to exchange heat between the process air within the closed-loop airflow path and the ambient air moved through the open airflow path, wherein the condensing heat exchanger includes a shroud that directs the ambient air through an interior of the condensing heat exchanger, wherein the open airflow path includes an ambient air inlet that is defined between the shroud and the exterior surface of the cabinet, and wherein the ambient air cools and dehumidifies the process air to form condensate on an interior surface of the condensing heat exchanger.

15. The condensing dryer of claim 14, wherein the open airflow path includes an external fan.

16. The condensing dryer of claim 15, wherein the external fan draws ambient air through the condensing unit.

17. The condensing dryer of claim 14, wherein the condensing heat exchanger is attached to the cabinet at a recess defined within the exterior surface of the cabinet.

18. The condensing dryer of claim 14, wherein the condensing heat exchanger includes airflow tubes having an interior surface that defines a portion of the closed-loop airflow path, wherein the airflow tubes include the exterior surface that defines a portion of the open airflow path.

19. A drying appliance comprising:

a cabinet;

a blower that directs process air through a closed-loop airflow path and through a processing chamber and a condensing unit, wherein the condensing unit is attached to an external surface of the cabinet, and wherein the condensing unit includes a shroud that directs ambient air through an interior of the condensing unit; and an open airflow path that directs the ambient air through the condensing unit and to an area exterior to the cabinet, wherein the open airflow path includes an ambient air inlet that is defined between the shroud and an exterior surface of the cabinet, and wherein the ambient air remains separated from the closed-loop airflow path.

20. The drying appliance of claim 19, wherein the open airflow path includes an external fan that is disposed within the shroud.

* * * * *